US005390729A

United States Patent [19]

Sakurai et al.

[11] Patent Number: 5,390,729

[45] Date of Patent: Feb. 21, 1995

[54] REFRACTORY ELEMENT

[75] Inventors: Akira Sakurai; Masahiro Shiotsu, both of Kyoto; Toshikazu Yano, Yokohama; Masao Ochi, Yokohama; Toshihiro Sugawara, Yokohama, all of Japan

[73] Assignee: Ishikawajima-Harima Jukogyo Kabushiki Kaisha, Tokyo, Japan

[21] Appl. No.: 111,910

[22] Filed: Aug. 26, 1993

Related U.S. Application Data

[60] Division of Ser. No. 73,619, Jun. 8, 1993, Pat. No. 5,329,785, which is a continuation of Ser. No. 695,693, May 3, 1991, abandoned.

[30] Foreign Application Priority Data

| | | | |
|---|---|---|---|
| May 21, 1990 | [JP] | Japan | 2-130563 |
| May 21, 1990 | [JP] | Japan | 2-130564 |
| May 21, 1990 | [JP] | Japan | 2-130565 |
| Oct. 4, 1990 | [JP] | Japan | 2-267142 |

[51] Int. Cl.[6] ..... F28D 5/02

[52] U.S. Cl. ..... 165/47; 62/315; 62/316; 52/168; 109/29; 109/33; 169/16; 169/48; 169/54; 169/62; 165/911; 165/907

[58] Field of Search ..... 169/16, 48, 54, 62; 52/168; 109/29, 33; 62/316, 315; 165/47, 907, 911

[56] References Cited

U.S. PATENT DOCUMENTS

| | | | |
|---|---|---|---|
| 2,941,759 | 6/1960 | Rice et al. | 62/316 |
| 3,090,212 | 5/1963 | Anderson | 244/117 A |
| 3,138,009 | 6/1964 | McCreight | 244/117 A |
| 3,605,412 | 9/1971 | Stockel | 60/267 |
| 4,301,631 | 11/1981 | Tazaki | 52/168 |
| 4,310,926 | 1/1982 | Maroist | 2/81 |
| 4,616,694 | 10/1986 | Hsieh | 62/316 |
| 4,935,169 | 6/1990 | Ernst | 62/316 |

FOREIGN PATENT DOCUMENTS

| | | |
|---|---|---|
| 140559 | 12/1988 | Japan . |
| 184886 | 1/1989 | Japan . |
| 184887 | 1/1989 | Japan . |
| 261128 | 4/1989 | Japan . |
| 131183 | 4/1990 | Japan . |

OTHER PUBLICATIONS

Hatumei Kyokai Kokai Giho No. 87-10813, published on Sep. 21, 1987.

Hatumei Kyokai Kokai Giho No. 87-10821, published on Sep. 21, 1987.

*Primary Examiner*—Albert W. Davis, Jr.

*Attorney, Agent, or Firm*—Oblon, Spivak, McClelland, Maier & Neustadt

[57] ABSTRACT

Cooling liquid flowing through cooling-liquid passages cools in heat-transmission manner an inner layer on an inner surface of an impermeable intermediate layer and is directed through a piping to an interface between the intermediate and outer layers, whereby the porous outer layer is cooled by latent heat generated by evaporation of the cooling liquid infiltrated into the porous outer layer.

4 Claims, 17 Drawing Sheets

REFRACTORY ELEMENT

This is a division of application Ser. No. 08/073,619, filed on Jun. 8, 1993, now U.S. Pat. No. 5,329,785 granted Jul. 19, 1994, which is a continuation of application Ser. No. 07/695,693, filed on May 3, 1991, now abandoned.

BACKGROUND OF THE INVENTION

The present invention relates to a refractory element.

Conventionally, a building or the like is fireproofed by using refractory interior and exterior members and/or heat-insulating members between interior and exterior members.

Upon fire, goods and the like are protected from burning by covering the same with refractory sheets.

Use of such refractory and/or heat-insulating members for fireproofing buildings or the like has the following problems:

(1) When a fire occurs outside a building or the like, intrusion of heat from the exterior to the interior of the building or the like cannot be completely prevented by the refractory and/or heat-insulating members, resulting in rise of temperature in the interior of the building or the like.

(2) Construction of refractory members and/or heat-insulating members will take a long time since they are separate parts.

In like manner, to cover goods and the like with refractory sheets may prevent the former from burning but cannot completely block intrusion of heat through the refractory sheets, resulting in degradation of and damages to the goods and the like.

In view of the above, the present invention was made to provide a refractory element which can maintain the interior temperature at a predetermined level and which can facilitate the construction when applied in the form of refractory panel.

SUMMARY OF THE INVENTION

According to the present invention, the above-mentioned objects are attained by a refractory element comprising an impermeable intermediate layer, an inner heat-transmission cooling layer with liquid passages for causing a cooling liquid to flow along an inner surface of the intermediate layer, a porous, outer, ooze cooling layer on an outer surface of the intermediate layer and a pipeline for directing the cooling liquid to an interface between the intermediate and outer layers whereby the liquid oozes through the pores of the outer layer.

The cooling liquid flowing through the passages cools in heat-transmission manner the inner layer and is directed through the piping to the interface between the intermediate and outer layers, whereby the porous outer layer is cooled by latent heat: generated by evaporation of the cooling liquid infiltrated into the porous outer layer.

The intermediate layer may be made of refractory and heat-insulating material to enhance a degree of fireproofness.

When the inner, intermediate; and outer layers are constructed in the form of panels, a refractory chamber, such as an emergency elevator and the like can be constructed easily.

When the inner, intermediate and outer layers are constructed in the form of sheet so as to cover goods and the like in case of fire, the degrading of quality and damages:of :he goods and the like can be prevented.

The present invention will become more apparent from the following description of preferred embodiments thereof taken in conjunction with accompanying drawings.

DETAILED DESCRIPTION OF THE PREFERRED EMBODIMENTS

First Embodiment, FIGS. 1–5

Figure 1:
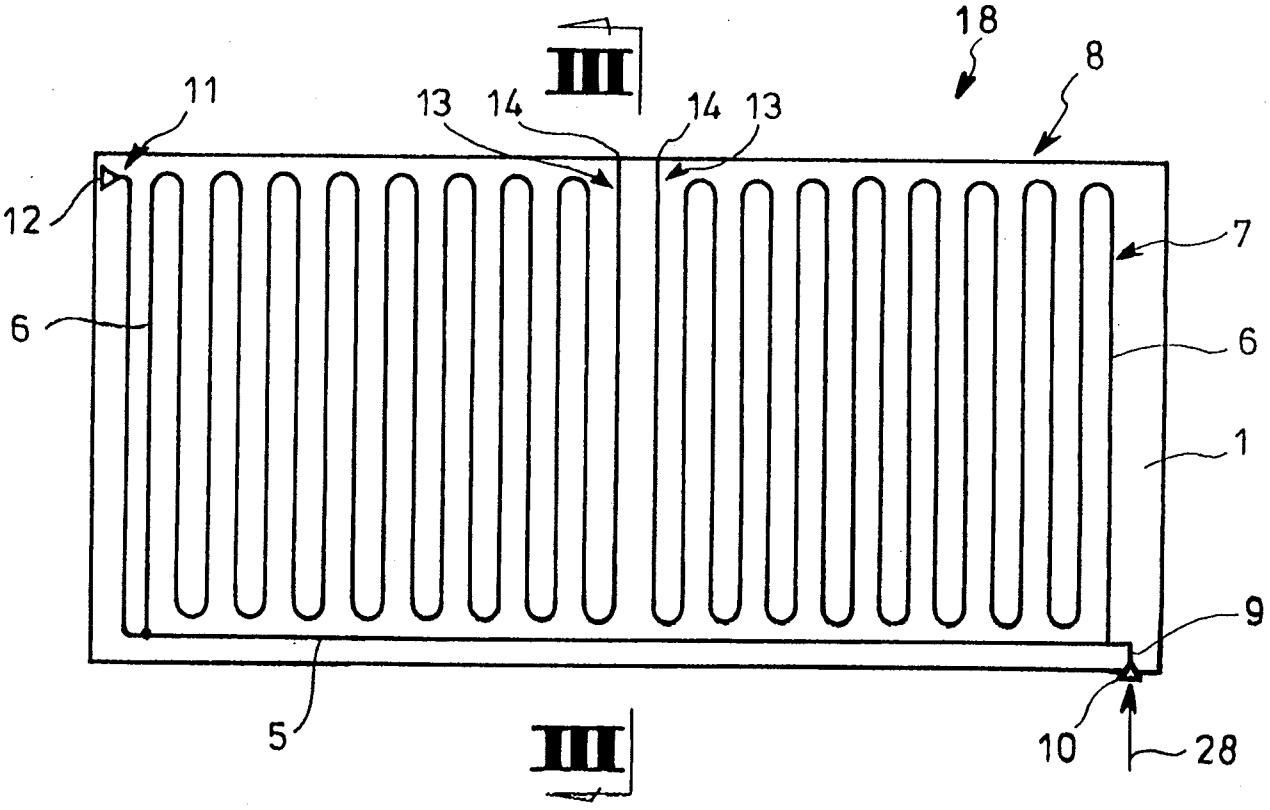
FIG. 1 is an inside view of a first embodiment of a refractory element according to the present invention.
Figure 2:
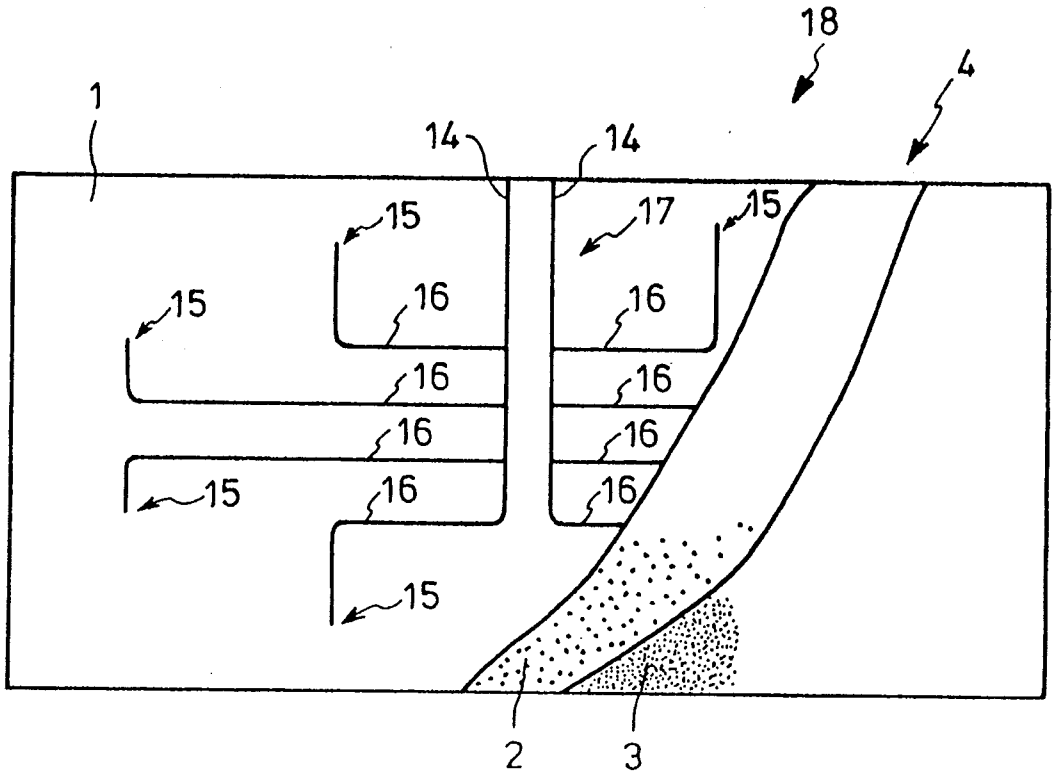
FIG. 2 is an outside view thereof.
Figure 3:
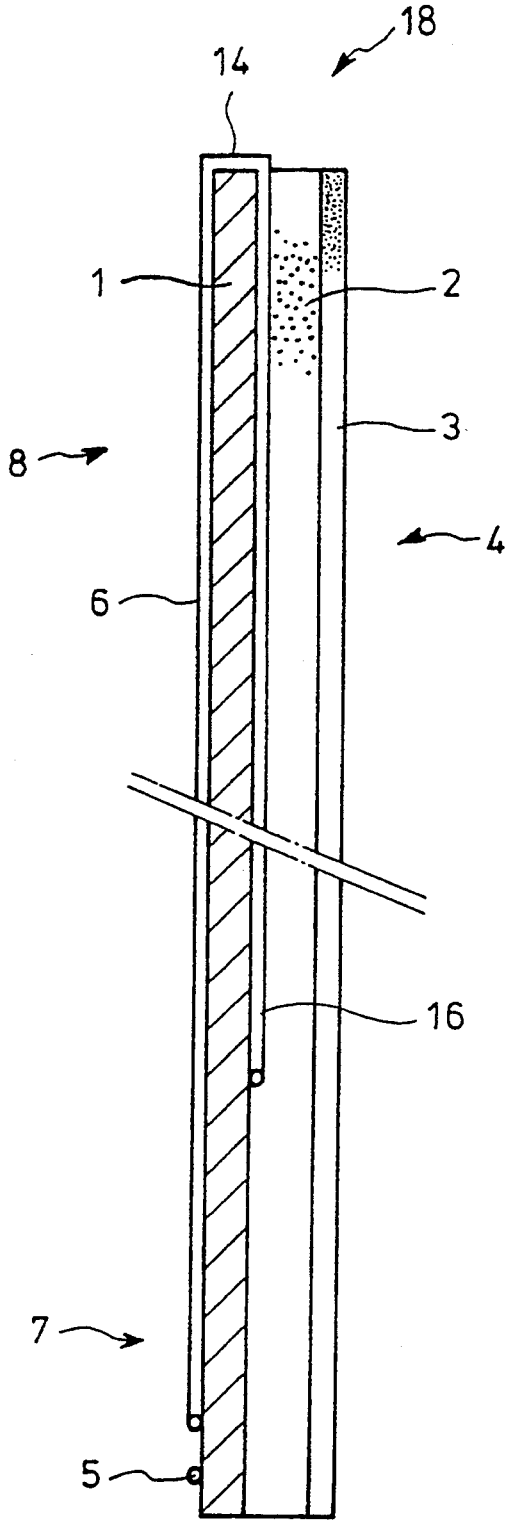
FIG. 3 is a sectional view taken along the line III—III in FIG. 1.

An impermeable intermediate layer 1, which is fabricated from a sheet of aluminum, stainless steel or the like, has its outer and inner surfaces on which are disposed an outer, porous, ooze cooling layer 4 and an inner heat-transmission cooling layer 8.

The outer layer 4 comprises a soft porous member 2 such as a sheet of ceramic paper made of fibrous $SiO_2$ and a hard porous member 3 such as a reinforced sheet of ceramic paper made of ceramic paper impregnated with silicon.

The inner layer 8 comprises a cooling piping 7 through which cooling liquid passes. The cooling piping 7 has a main pipe section 5 extending along a base line and along one side line of the intermediate layer 1 and branched pipe sections 5 each connected at its one end to the main pipe section 5 and meanderingly disposed on the inner surface of the intermediate layer 1. A cooling liquid supply opening means 10 in the form of a readily attachable joint or the like is joined to an inlet end 9 of the cooling piping at the lower end of the main pipe section 5.

A cooling liquid distribution port means 12 in the form of a readily attachable joint or the like and engageable with the opening means 10 is attached to a distribution end 11 of the cooling piping 7 at the upper end of the main pipe section 5.

An extension pipe 14 extends from a terminal end 13 of the cooling piping 7 at the other end of each branched pipe section 6 over the upper side of the intermediate layer 1 to a rear surface thereof.

The extension pipe 14 is connected to a pipeline 17 comprising a plurality of branched pipe sections 16 each having at its leading end a cooling-liquid oozing port 15 and disposed between the intermediate layer 1 and the porous member 2.

The refractory elements with the above-described construction in the form of panel (which is often referred to as refractory panels 18 in this specification) are joined to a frame 19 with the heat-transmission cooling layer 8 and the ooze cooling layer 4 being at the inside and outside, respectively, thereby providing a refractory chamber 20.

Figure 4:
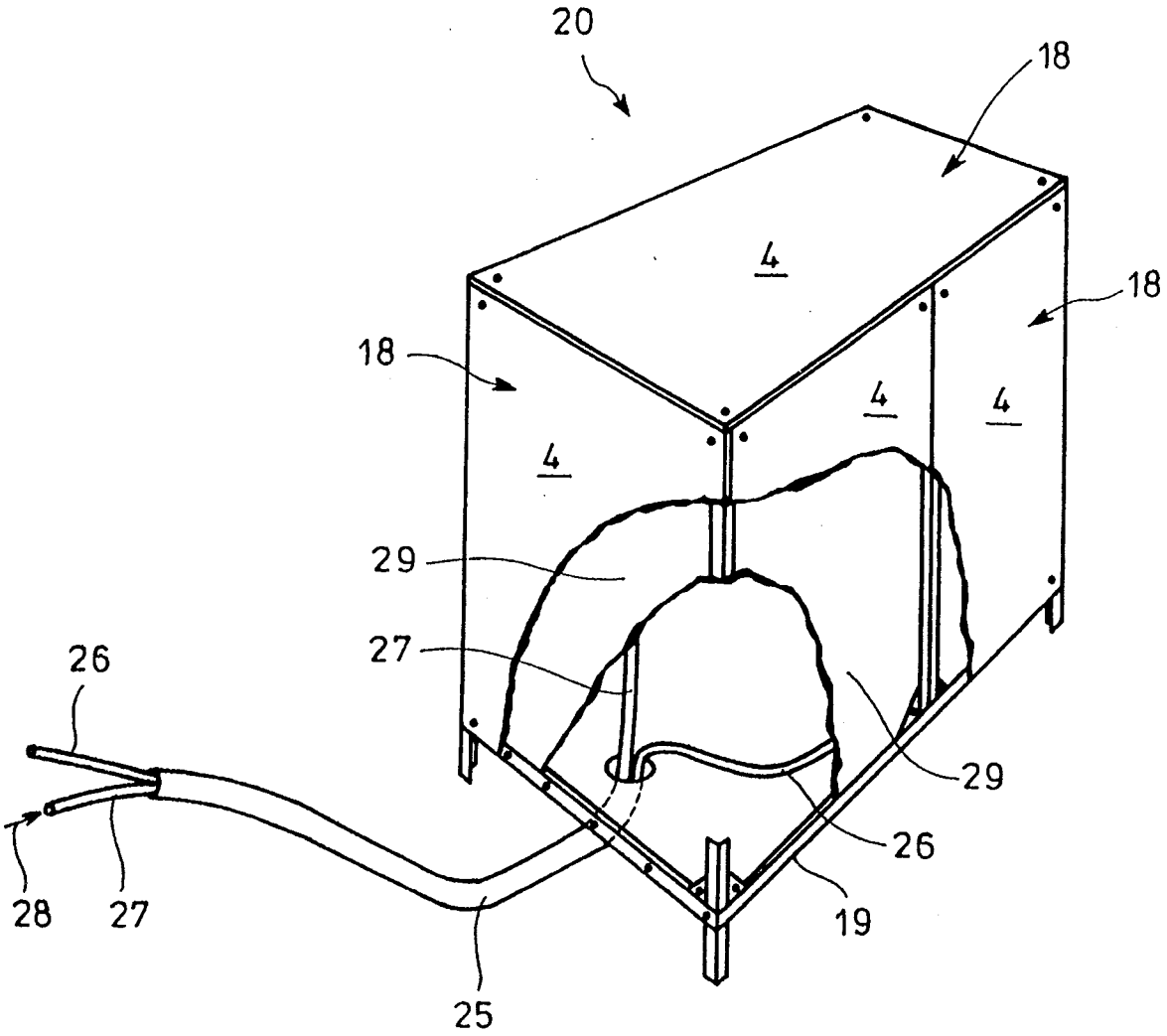
FIG. 4 is a partially cutaway :perspective view of a refractory chamber constructed by the refractory elements shown in FIG. 1.
Figure 5:
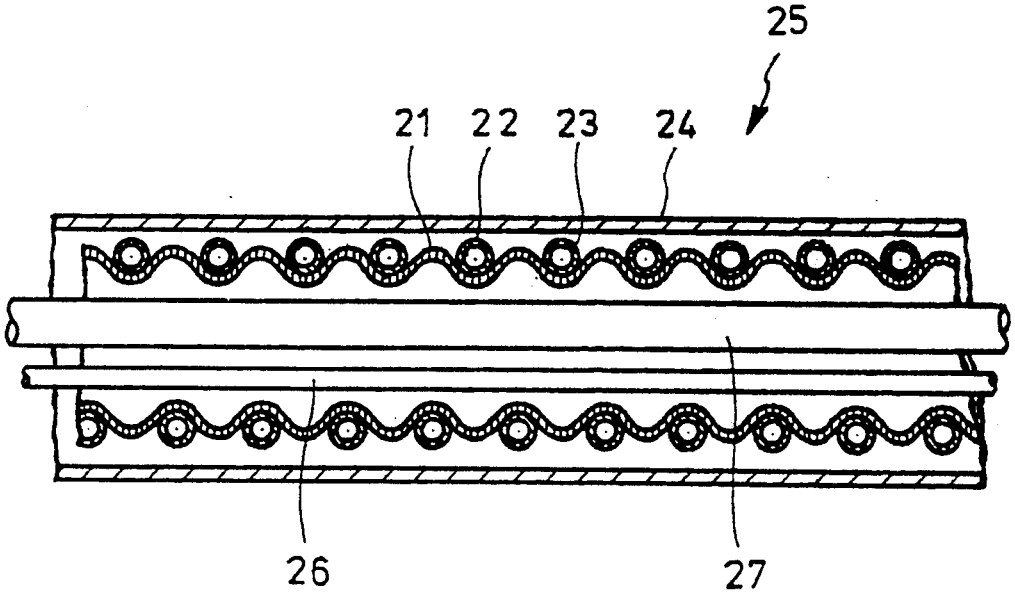
FIG. 5 is a sectional view of a heat-resistant, flexible pipe used in the refractory chamber shown in FIG. 4.
Figure 6:
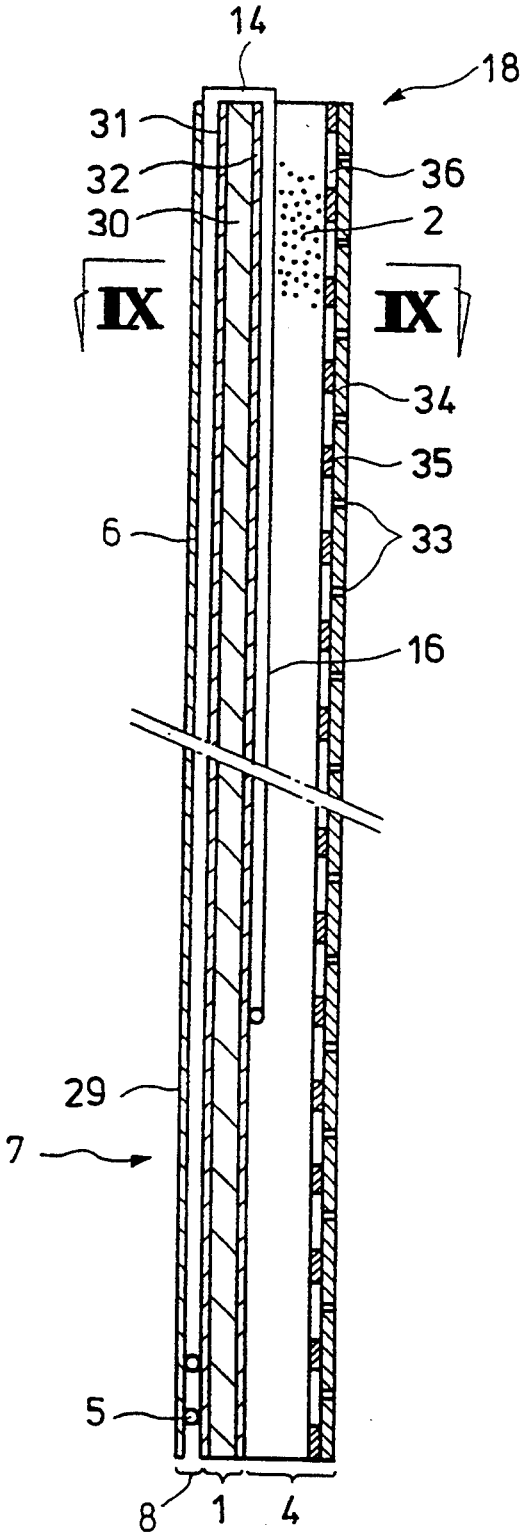
FIG. 6 is a sectional view of a second embodiment of a refractory element according to the present invention.
Figure 7:
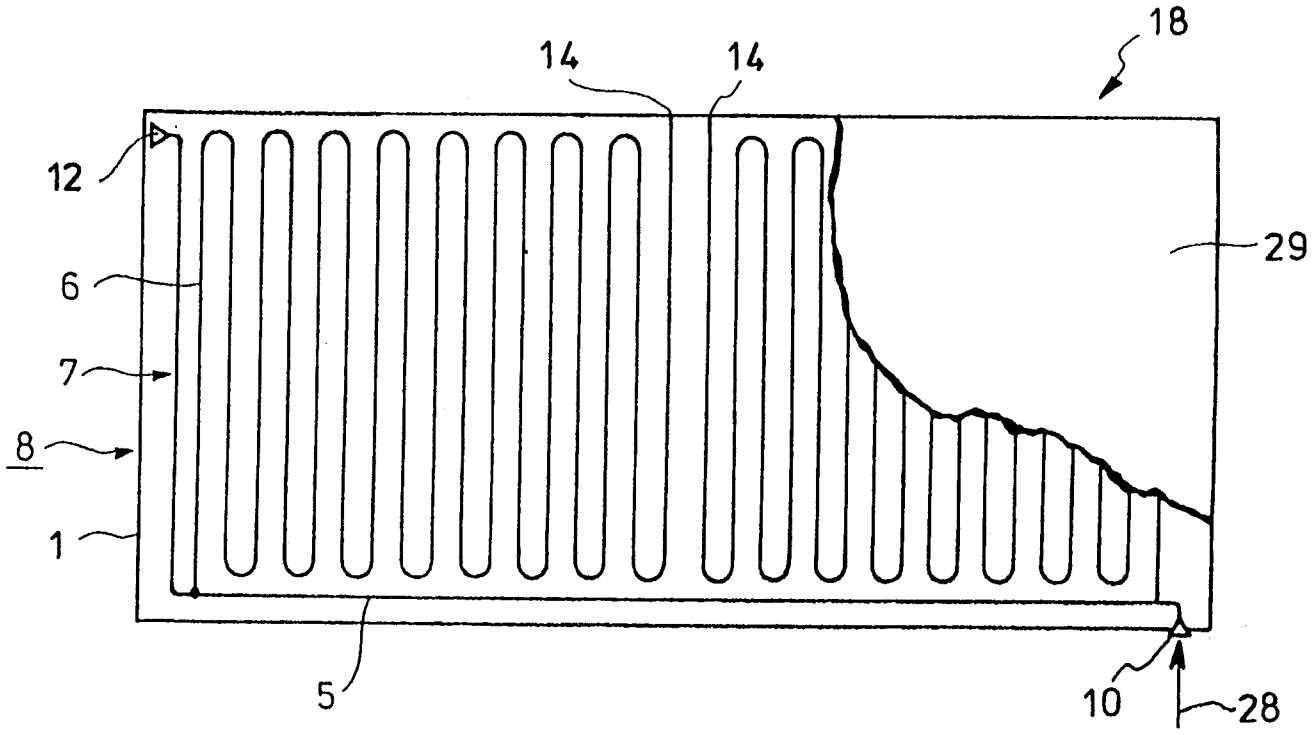
FIG. 7 is a partially cutaway view illustrating the inside thereof.
Figure 8:
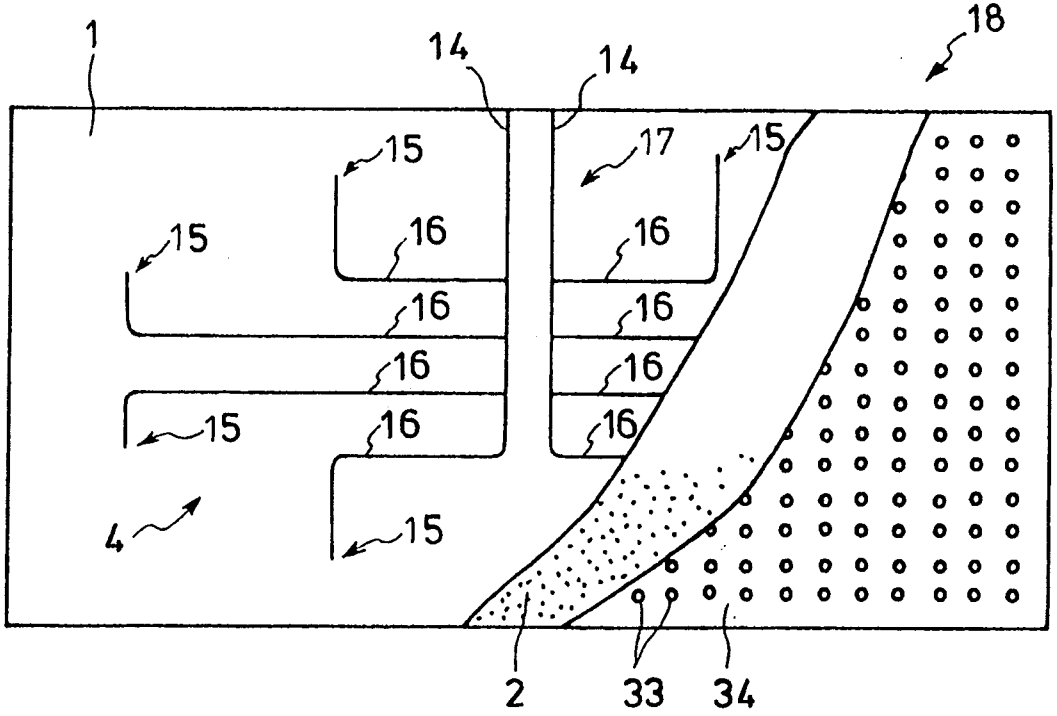
FIG. 8 is a partially cutaway outside view of the second embodiment shown in FIG. 6.
Figure 9:
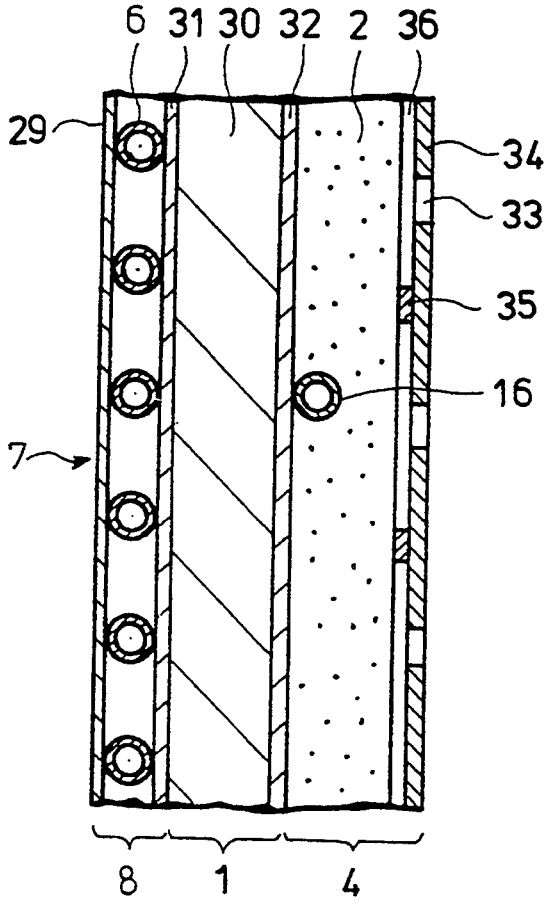
FIG. 9 is a sectional view taken along the line XI—XI in FIG. 6.

As best shown FIGS. 4 and 5, a refractory casing, broadly indicated by the numeral 25, is provided for a liquid pressure pipe 27 which supplies liquid to the piping of the respective panels. The refractory casing 25 includes a cooling liquid supply tube 23, made of copper and having openings 22 therethrough, which is spirally wound around a flexible conduit 21 of corrugated stainless steel or the like, and which is covered along its length with a permeable refractory cloth sleeve 24 such as silica cloth. The casing 25 is connected at its one end to the bottom or a wall of the refractory chamber 20 and an electrical cable 26, as well as the supply pipe 27, extend through the casing 25 into the refractory chamber 20.

The supply pipe 27 is connected to the port means 10 of each refractory panel 18 (in this case, the distribution port means 12 of each panel 18 is closed); alternatively, when the cooling pipings 7 of the refractory panels 18 are being communicated with each other in series by connecting the port means 12 and 10, the supply pipe 27 is connected to an unconnected one of the supply port means 10 (in this case an unconnected one of the distribution port means 12 in the last panel is closed).

Reference numeral 28 denotes a cooling liquid; and 29, an inner material covering the inner layer & of the refractory panel 18.

Next the mode of operation of the refractory panel 18 of the type described above will be described in detail.

Normally the cooling liquid 28 is not made to flow through the supply pipe 27 extending through the flexible casing 25 and the supply tube 23 wound around the flexible conduit 21 in the casing 25.

In case of a fire, in response to a fire alarming system, cooling liquid 28 is forced to flow through tube 23 and pipe 27. Alternatively, this operation may be manually started by a person in charge of fire prevention.

Then, in the refractory flexible casing 25, the cooling liquid 28 oozes through the openings 22 of the supply tube 23 around the flexible conduit 21 and is spread through the permeable refractory cloth 24 by the capillary action to thereby wet the whole surface of the refractory cloth 24.

When the thus wholly wet refractory cloth 24 on the refractory flexible casing 25 is exposed to fire from the exterior, the cooling liquid 28 evaporates through the cloth 24 to dissipate the heat of the cloth 24 as latent heat, whereby the casing 25 is protected from heat. The cooling liquid 28 is continuously supplied by the capillary action to the cloth 24 from which the cooling liquid is evaporating. Therefore, the refractory cloth 24 can be maintained in a wetted state as long as the quantity of the cooling liquid to flow through the supply tube 23 is maintained at a suitable level.

Since the refractory casing 25 is protected from heat in the manner described above, stable and dependable supply of the cooling liquid 28 to the refractory chamber 220 through the supply pipe 27 can be ensured.

In the refractory chamber 20 the cooling liquid 28 is supplied through the supply pipe 27 to the supply port means 10 of each refractory panel 18. As a result, the cooling liquid 28 flows through the main pipe section 5 and the branched pipe sections 16, thereby cooling the inner, heat-transmission cooling layer 8. Therefore, in the interior of the refractory panels 118 and thus in the refractory chamber 20, the temperature is maintained at a constant level.

Thereafter, the cooling liquid 28 is introduced through the extension pipe 14 into the branched pipe sections 16 of the pipeline 17 and then discharged through the discharge ports 15.

The discharged cooling liquid 28 infiltrates into the porous materials 2 and 3 of the outer layer 4 by the capillary action to wet the whole surface of the layer 4.

When the refractory chamber 20 is exposed to the exterior heat under the condition of the cooling layer 4 being maintained in a wholly wetted state, the cooling liquid 28 evaporates from the cooling layer 4 to dissipate the heat on the layer 4 as evaporation latent heat to thereby prevent intrusion of heat from the exterior into the interior of the refractory chamber 20.

According to the present invention, after the cooling liquid 28 has been used to cool the inner, heat-transmission cooling layer 8 in the refractory chamber 20, it is used again to cool the outer, ooze cooling layer 4. Therefore, a high degree of cooling efficiency is obtained by less amount of cooling liquid.

In addition, the outer, intermediate and inner layers 4, 1 and 8 are integrally incorporated in the form of the refractory panel 18, whereby the fabrication or construction of a refractory chamber 20 can be much facilitated.

As described above, the temperature in the refractory chamber 20 can be maintained constant or a predetermined level, the refractory chamber 20 is adapted to be used as a shelter or a computer room. In addition, corridors in a building may be lined with the refractory panels 18 so as to be used as an emergency evacuation route in case of fire.

Second Embodiment. FIGS. 6–12

A second embodiment of the present invention is different from the first embodiment described above in that the refractory intermediate layer 1 comprises a refractory member 30 and impermeable members 31,32 such as sheets of aluminum or stainless steel, the latter members 31,32 being bonded to opposite surfaces of the former member 30 in sandwich manner, and that an outer, ooze cooling layer 4 comprises a porous member 2 having an outer surface to which an exterior member 34 such as a sheet of stainless steel or a heat-resisting composite member with a large number of pores 33 is bonded through spacers 35 so as to provide vapor passages 36.

In addition, an interior member 29 is preliminarily bonded to the cooling piping 7.

Figure 10:
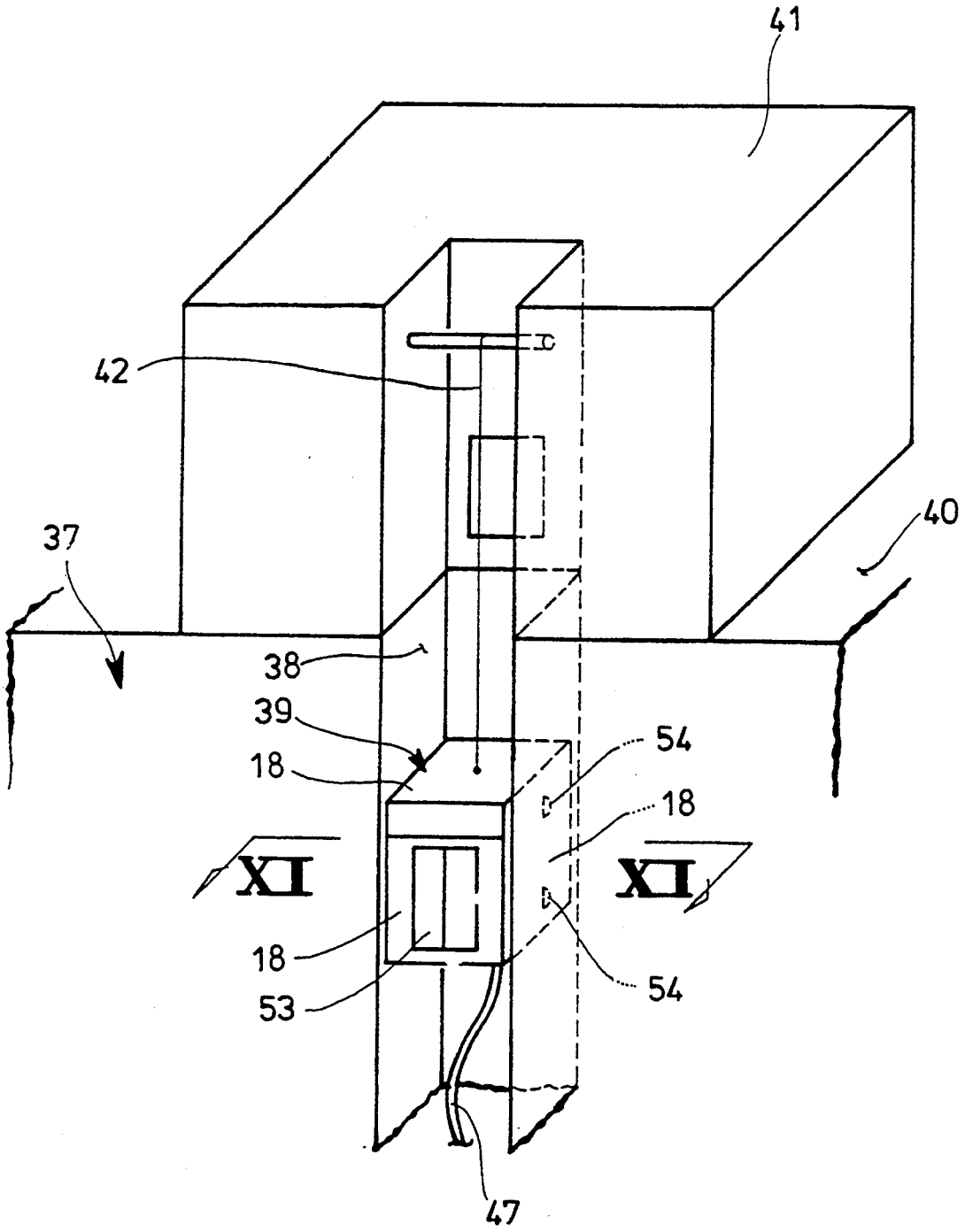
FIG. 10 is a perspective view illustrating an elevator constructed by the refractory elements shown in FIG. 6.
Figure 11:
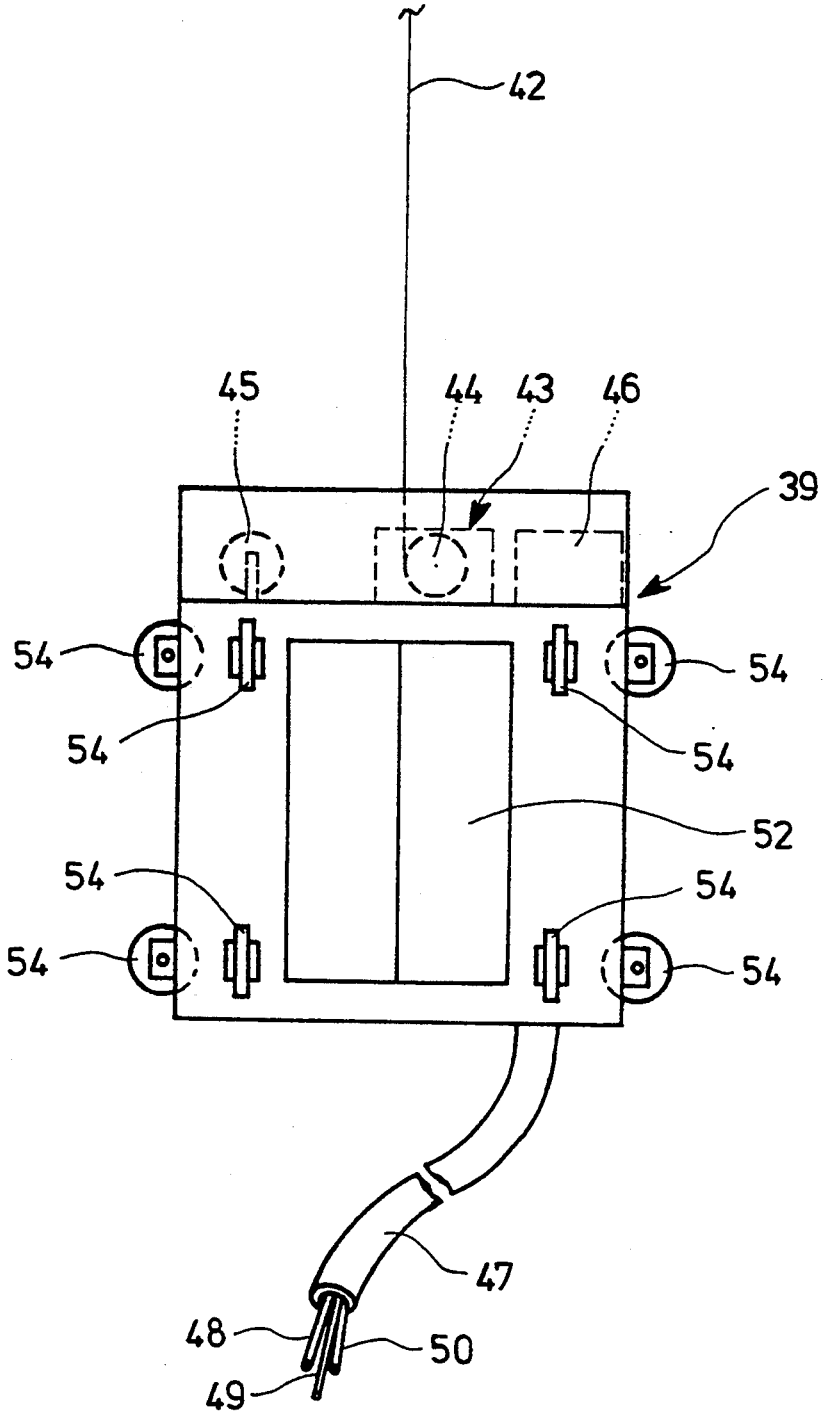
FIG. 11 is a sectional view taken along the line XI—XI in FIG. 10.
Figure 12:
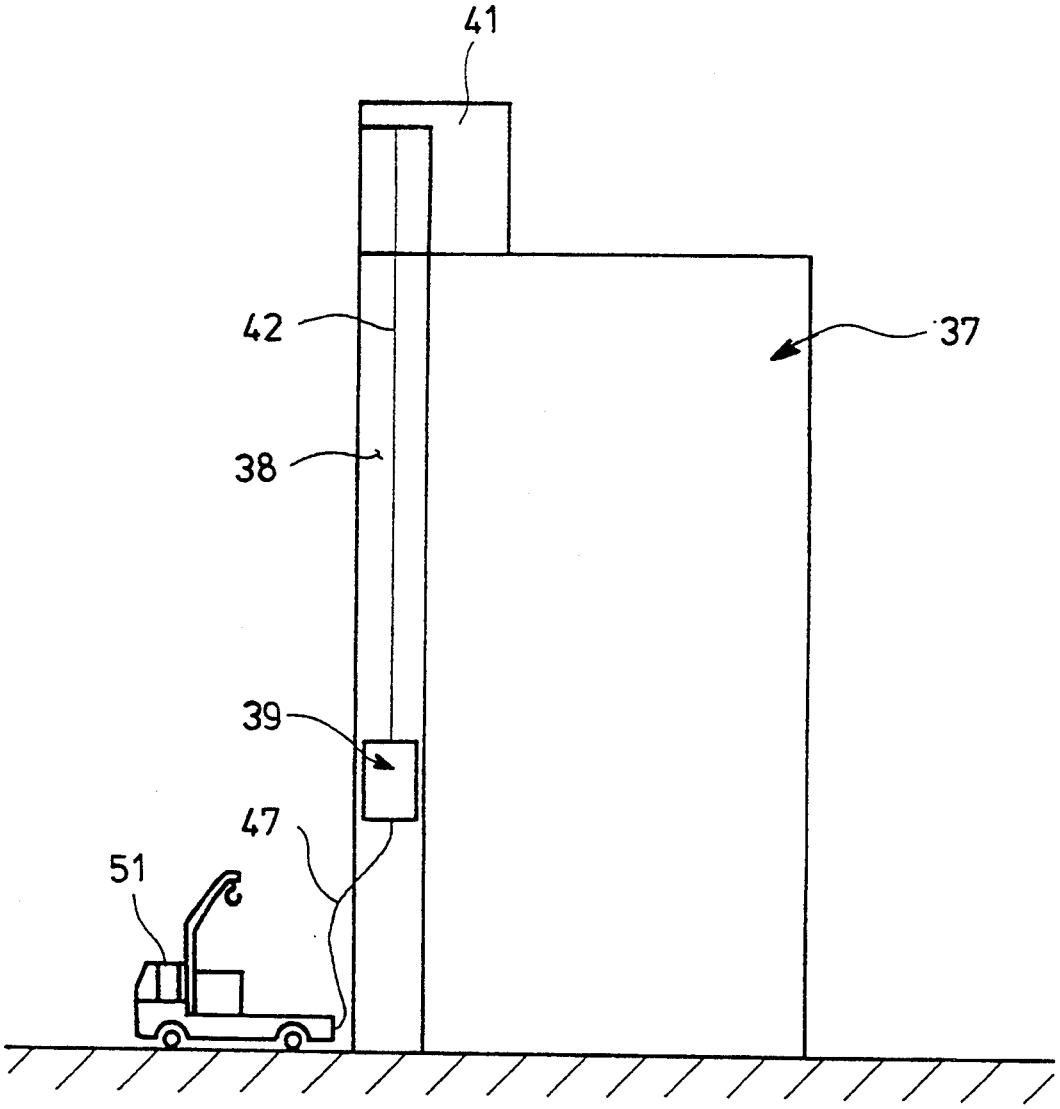
FIG. 12 is a view illustrating an ambulance trailer connected to a refractory cable shown in FIG. 10.

The refractory panels 18 with above-described construction are used to construct, for example, an elevator as shown in FIGS. 10–12.

A vertically extending recess 38 is defined on an outer wall of a high building 37. An emergency elevator body 39 with walls made of or lined with the refractory panels 18 is located within the recess 38 such that it can be vertically movable. More specifically, the elevator body 39 is suspended by a wire 42 from an emergency exit room 41 constructed on a top 40 of the building 37.

The wire 42 is securely joined at its upper end to an upper portion of the exit room 41 while a lower end thereof is wound around the winch drum 44 of a lift apparatus 43 securely joined to a top of the elevator body 39 so that when the wire 42 is wound or unwound by the winch drum 44, the elevator body 39 is lifted or lowered.

The refractory panels 18 are bonded to the elevator body 39 such that the heat-transmission cooling layers 8 define interior walls of the elevator body 39 while the ooze cooling layers 4 define exterior walls.

Installed on the top of the elevator body 39 are an emergency air cylinder 45 capable of supplying air into the elevator body 39 and a water supply system or water tank 46 which is normally filled with a predetermined quantity of water and which is communicated through valves (not shown) to the cooling pipings 7 of the refractory panels 18 (See FIG. 11).

One end of a refractory cable 47 extending from the exterior of the building 37 is connected to a predetermined position of the elevator body 39 such that a water supply pipe 48 for supplying the water into the water tank 46, an electric power cable 49 for supplying the power to the lift system 43 and an air supply pipe 50 for supplying the air into the elevator body 39 independently of the air storage cylinder 45 extends through the refractory cable 47 from the exterior of the building 37 into the elevator body 39.

The other end of the refractory cable 47 is connected to, for example, a rescue trailer 51 as shown in FIG. 12 which is equipped with a generator, a water pump, an air pump and the like and which is parked near the building 37.

Reference numeral 52 indicates an entrance door; 53, an exit door; and 54, guide rollers for prevention of direct contact of the elevator body 39 with the building 37 during lifting or lowering of the body 39.

Next the mode of operation of the second embodiment will be described.

Normally, the wire 42 is wound around the winch drum 44 of the lift system 43 to stop the elevator body 39 within the emergency exit room 41. In case of a fire, evacuees in the building 37 go up to the top 40 of the building 37 and then open the doors 52 and escape into the elevator body 39. Next, the valve of the air storage cylinder 45 is opened to fill the interior of the elevator body 39 with fresh air so that the pressure therein rises slightly in excess of the atmospheric pressure, thereby preventing the intrusion of the smoke into the interior of the elevator body 39. Thereafter, the valve of the water storage cylinder 46 is opened to supply the water to the cooling pipings 7 of the refractory panels 18.

The water supplied into each of the cooling pipings 7 cools the surface of the heat-transmission cooling layer 8 of the refractory panel 18 or the interior of the elevator body 39 and is introduced into the pipeline 17 and discharged through the discharge holes 15 so that it infiltrates into tile porous member 2 of the ooze cooling layer 4. thereby wetting the same.

On the ground, the other end of the refractory cable 47 is immediately connected to the rescue trailer 51 so as to supply the electric power, water and air into the elevator body 39.

When tile refractory cable 47 is connected to tile rescue trailer 51, the evacuees in the elevator body 39 operate the lift system 43 to lower the elevator body 39. Upon arrival on the ground, they open the exit doors 53 and wet out of the elevator body 39.

In this case, when the elevator body 39 is exposed to the heat from the fire as it is lowered, as in the case of tile first embodiment, the water evaporates through the surface of the porous members 2 of the refractory panels 18 to dissipate heat from the ooze cooling layer 4 as the latent heat. As a result, intrusion of heat from the exterior to the interior of the elevator body 39 can be prevented.

In addition, because of the refractory intermediate layer 1 inwardly of the outer layer 4, intrusion of heat from the exterior can be substantially prevented.

Therefore, the evacuees can be protected from heat and escape safely from the high building 39.

In the second embodiment, so far the electric power has been described as being supplied from the rescue trailer 51 through the heat-resisting cable 47. This is because there is a possibility that the electric power source in the building 37 cannot be used. But, a further lift system for winding or rewinding the wire 42 may be disposed on the top of the rescue room 41 to be energized by the power from a power source in the building 37. The lift system 43 and this further lift system may be used alternatively or in combination.

The reason why the air and water are supplied through the refractory cable 47 from the rescue trailer 51 is that when many persons are to escape from the building 37 in fire, the elevator body 39 must be shuttled or repeatedly lowered and lifted so that there is a fear of the air and water supply being exhausted from the air storage cylinder 45 and the water tank 46. The air and water may be directly supplied to the interior of the elevator body 39 from the rescue trailer 51 without providing the elevator body 39 with the air storage cylinder 45 and the water tank 46. In this case, it is apparent that the water pump on the rescue trailer 51 is used as a water supply to the elevator body 39.

It should be noted here that the refractory cable 47 is wound or unwound by a winch drum which has connecting means for the water, electric power and air supply sources.

Figure 13:
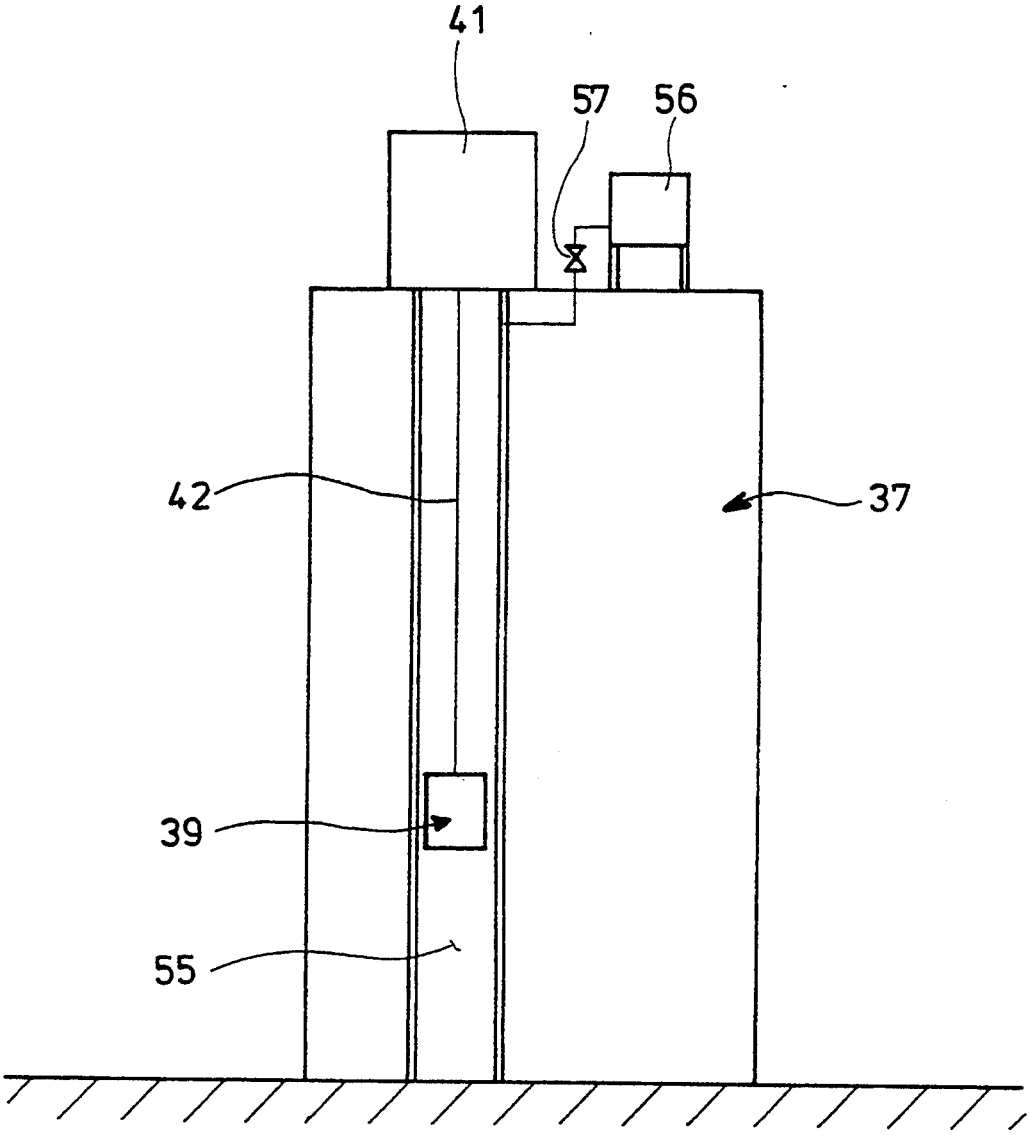
FIG. 13 is a schematic view of an elevator.

FIG. 13 illustrates another example of an elevator constructed with the refractory panels 18 according to the present invention. In this example, the inner walls of an elevator shaft 55 are constructed or lined with the refractory panels 18 which are communicated through a valve 57 with a water storage tank 56 constructed on the top of the building 37.

Figure 14:
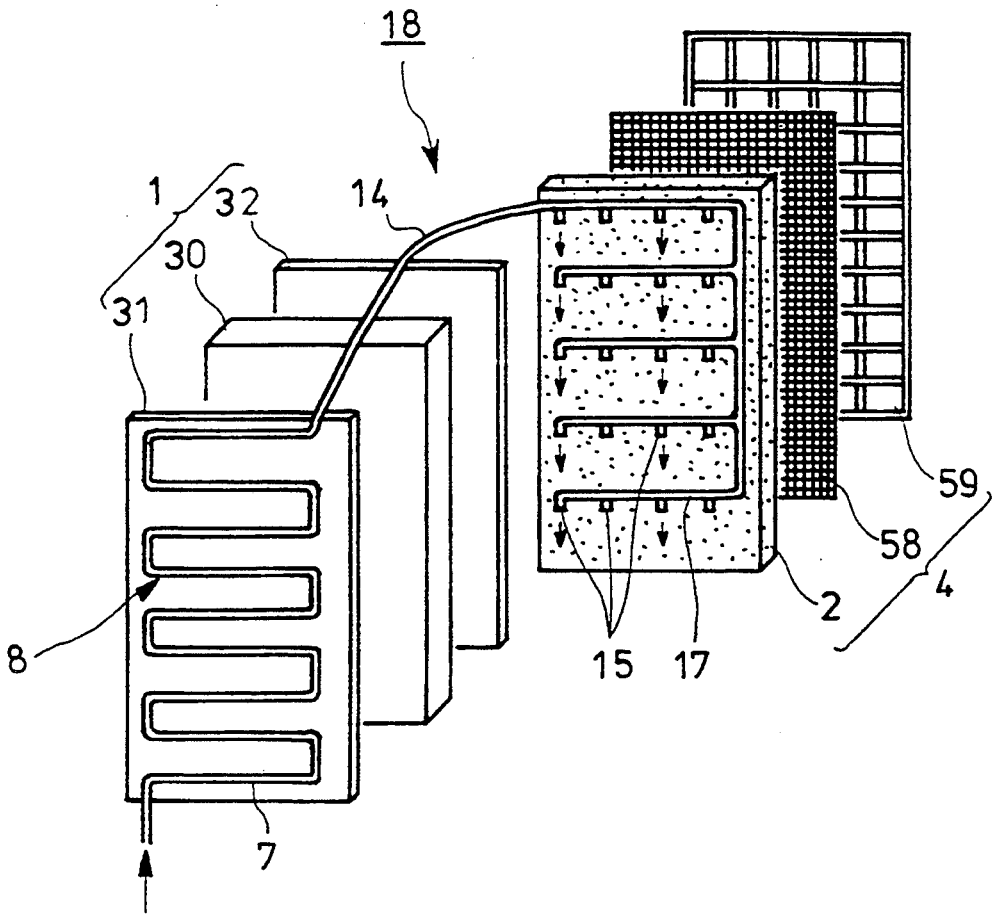
FIG. 14 is an exploded perspective view illustrating a third embodiment of a refractory element according to the present invention.
Figure 15:
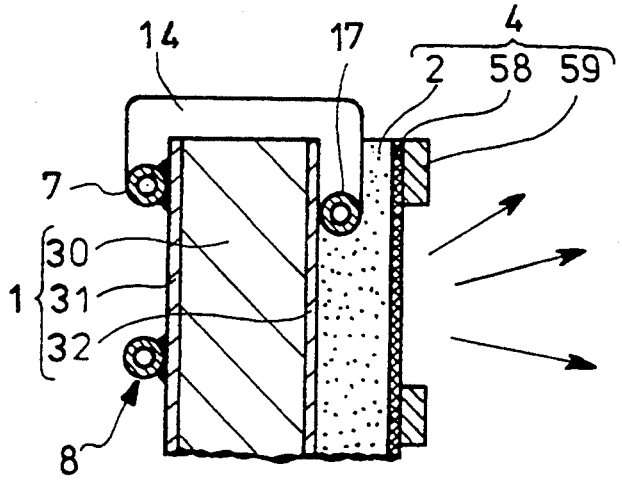
FIG. 15 is a sectional view thereof.

As described above, the walls of the elevator shaft 55 are constructed or lined with the refractory panels 18 so that in case of fire, temperature rise in the shaft 55 can be prevented to further ensure the safety of the evacuees, Third Embodiment, FIGS. 14 and 15

The third embodiment is substantially similar in construction to the first and second embodiments described above except that the outer, ooze cooling layer 4 comprises the porous member 2, a wire net 58 and a lattice 59. The third embodiment can also attain the features attained by the first and second embodiments.

Figure 16:
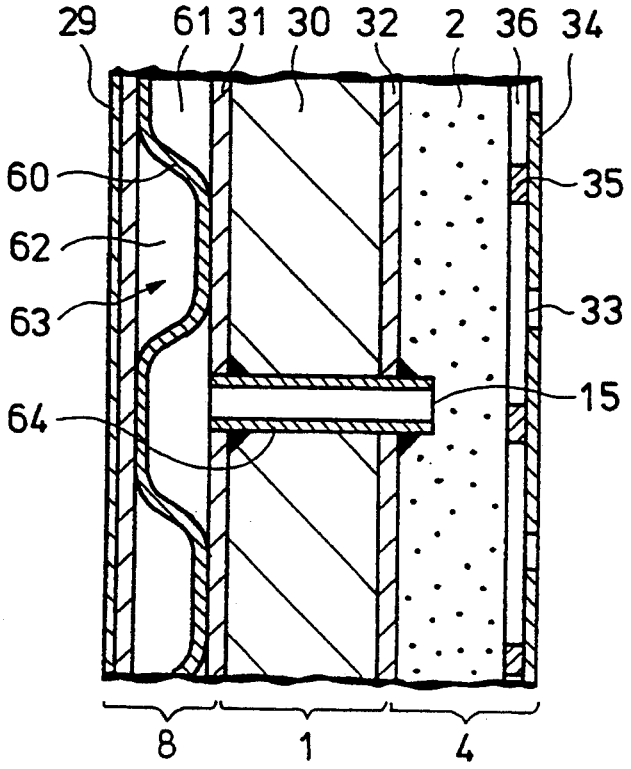
FIG. 16 is a sectional view of a fourth embodiment of a refractory element according to the present invention.
Figure 17:
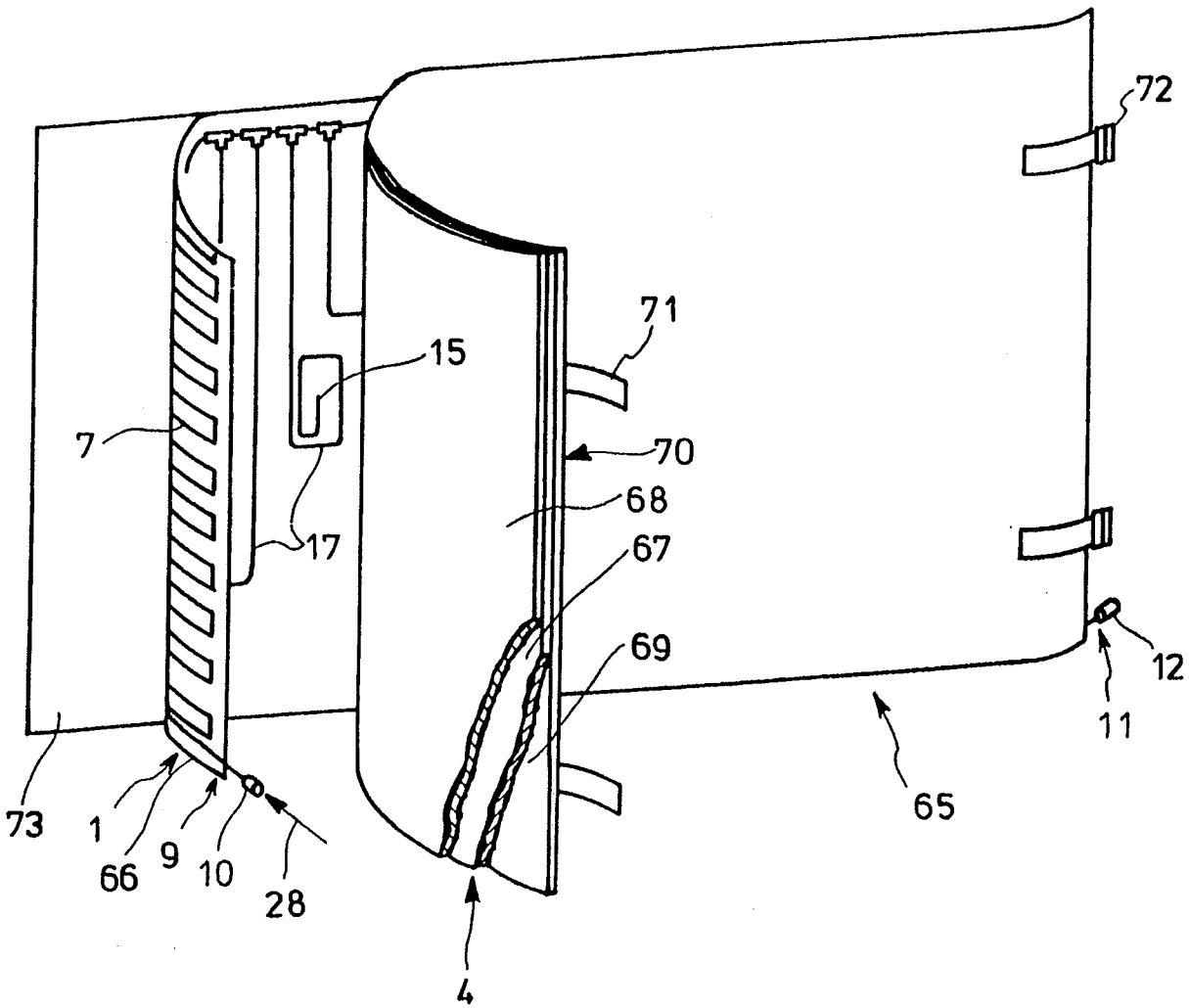
FIG. 17 is a partially cutaway perspective view of a fifth embodiment of a refractory element according to the present invention.
Figure 18:
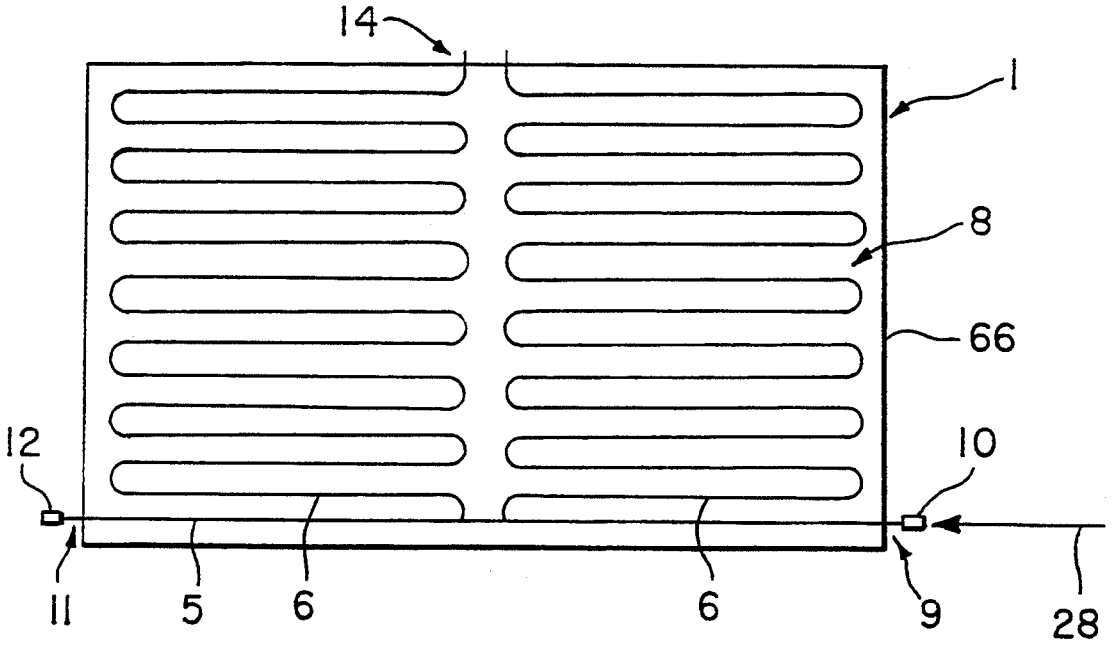
FIG. 18 is a view illustrating a heat-transmission cooling surface of the fifth embodiment shown in FIG. 17.
Figure 19:
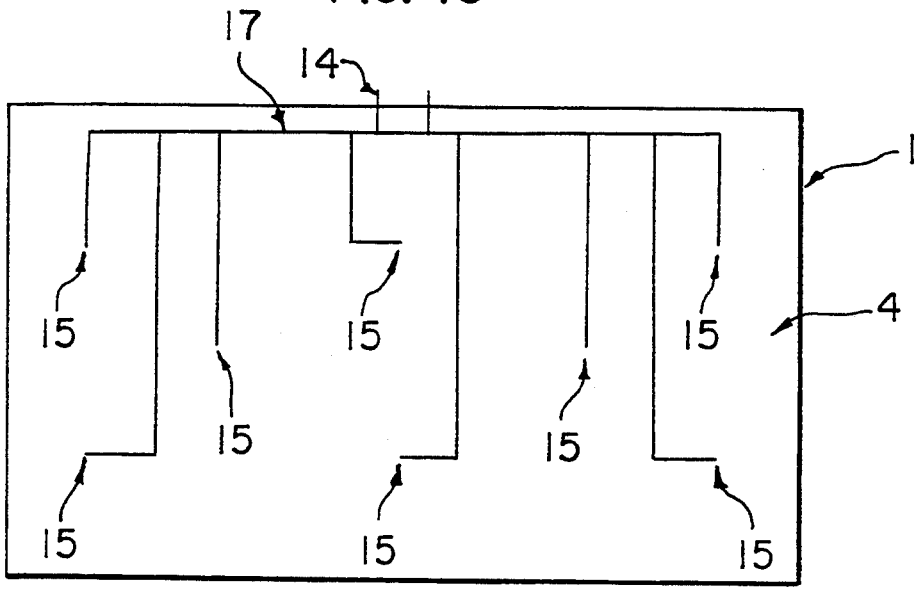
FIG. 19 is a view illustrating an ooze cooling surface of the fifth embodiment shown in FIG. 17.
Figure 20:
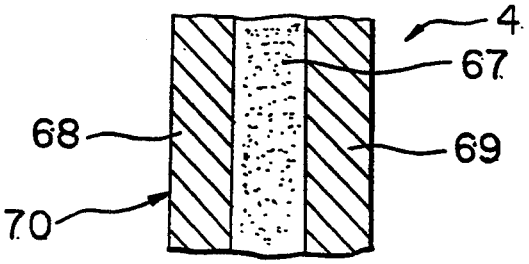
FIG. 20 is a partial sectional view of FIG. 17.

Fourth Embodiment, FIG. 16

The fourth embodiment is substantially similar in construction to the first, second and third embodiments except that the inner, heat-transmission cooling layer 8 comprises a cooling liquid jacket 63 which has a corrugated plate 60 to defines cooling liquid passages 61 and 62 on both surfaces of the plate 60 and a pipeline 64 which extends from the jacket 63 through the heat-insulating intermediate layer 1 to the porous member 2. The fourth embodiment also can attain the effects attained by the first, second and third embodiments.

Fifth Embodiment, FIGS. 17–20

In the fifth embodiment, the refractory element 65 is constructed in the form of a blanket.

More specifically, the intermediate layer 1 comprises a heat-resisting sheet 66 such as Kevlar (trademark) cloth on both surfaces of which aluminum is deposited.

The cooling piping 7 comprising nylon tubes, Teflon (trademark) tubes, cooper tubes or the like is sewed to the refractory sheet 66 and is covered with the interior member 73 which in turn is made of material substantially similar to that of the heat-resisting sheet 66, thereby constructing the heat-transmission cooling layer 8. Porous ceramic paper 67 is sandwiched by silica cloth sheets 68 and 69 which are made by weaving silica fibers and they are integrated into a cloth-like body 70, thereby constructing the ooze cooling layer 4.

Belts 71 and buckles 72 are respectively attached to opposite sides of the refractory blanket 65.

Except the above, the fifth embodiment is substantially similar in construction to the first to the fifth embodiments and also can be used in a similar manner described above. Therefore, the effects and features attained by the above-described embodiments can be also attained by the fifth embodiment.

It is to be understood that the present invention is not limited to the above-described embodiments and that various modifications may be effected without departing from the true spirit of the present invention.

What is claimed is:

1. A refractory chamber comprising a frame defining the dimensions of said chamber and a plurality of refractory building panels joined contiguously to said frame to enclose said chamber and retain the interior cool when the exterior of said chamber is subjected to excessive heat, each panel comprising an impermeable intermediate layer having inner and outer faces, a heat transmission layer joined to the inner face of said intermediate layer and comprising first liquid passages arranged along and throughout said inner face and including a liquid supply port for connecting said first liquid passages to a liquid supply pipe for supplying liquid under pressure to said first passages to attain a cooling effect throughout said inner face, a porous ooze cooling layer joined to the outer face of said intermediate layer, second liquid passages disposed between the outer face of said intermediate layer and said porous ooze cooling layer and including a plurality of outlet ports opening into said ooze cooling layer, and fluid passage joints interconnecting said first and second liquid passages to distribute cooling liquid throughout said ooze cooling layer when liquid under pressure is delivered through said supply pipe and inlet port to said first liquid passages, said porous ooze cooling layer comprises a soft porous inner layer of refractory material and an outer layer of refractory rigid liquid pervious material.

2. The chamber of claim 1 including an air pipe and an electrical power cable also located in said conduit.

3. The refractory chamber of claim 1 wherein each panel has opposed ends, said liquid supply port of each panel being located adjacent one end thereof, a liquid distribution port connected to said first liquid passages adjacent the opposite end of each panel, each distribution port of one panel being connectable to a supply port of an adjacent panel.

4. A refractory chamber comprising a frame defining the dimensions of a chamber and a plurality of refractory building panels joined contiguously to said frame to enclose said chamber and retain the interior cool when the exterior of said chamber is subjected to excessive heat, each panel comprising an impermeable intermediate layer having inner and outer faces, a heat transmission layer joined to the inner face of said intermediate layer and comprising first liquid passages arranged along and throughout said inner face and including a liquid supply port for connecting said first liquid passages to a liquid supply pipe for supplying liquid under pressure to said first passages to attain a cooling effect throughout said inner face, a porous ooze cooling layer joined to the outer face of said intermediate layer, second liquid passages disposed between the outer face of said intermediate layer and said porous ooze cooling layer and including a plurality of outlet ports opening into said ooze cooling layer, and fluid passage joints interconnecting said first and second liquid passages to distribute cooling liquid throughout said ooze cooling layer when liquid under pressure is delivered through said supply pipe and inlet port to said first liquid passages, a flexible refractory casing for said liquid pressure supply pipe, said casing having one end encompassing an outlet of a source of liquid under pressure and its other end sealingly connected through a wall of said chamber into the interior thereof, said casing comprising a flexible conduit surrounding said supply pipe, a tube for cooling liquid wrapped spirally around said conduit and having openings therethrough along the length thereof, and a sleeve of permeable refractory cloth material covering said conduit and tube along the length thereof and positioned to receive and be soaked by cooling liquid exiting the openings in said tube.

* * * * *